United States Patent [19]

Weirich et al.

[11] 4,191,498

[45] Mar. 4, 1980

[54] HYDRAULIC ROOF SUPPORT CONTROL SYSTEM

[75] Inventors: Walter Weirich, Dortmund; Harry Rosenberg, Lüdinghausen, both of Fed. Rep. of Germany

[73] Assignee: Gewerkschaft Eisenhutte Westfalia, Lunen, Fed. Rep. of Germany

[21] Appl. No.: 909,087

[22] Filed: May 24, 1978

[30] Foreign Application Priority Data

Jul. 22, 1977 [DE] Fed. Rep. of Germany ..... 2733270

[51] Int. Cl.[2] ..... E21D 15/44

[52] U.S. Cl. ..... 405/302; 91/404; 405/291

[58] Field of Search ..... 405/302, 291–301; 91/170 MP, 410, 408, 404, 394, 395, 396; 299/31, 33

[56] References Cited

U.S. PATENT DOCUMENTS

| | | | |
|---|---|---|---|
| 2,587,182 | 2/1952 | Livers | 91/404 |
| 3,246,576 | 4/1966 | Kibble et al. | 405/302 X |
| 3,246,730 | 4/1966 | Bolton et al. | 405/302 X |
| 3,259,024 | 7/1966 | Kibble et al. | 405/302 X |
| 3,306,050 | 2/1967 | Andrews et al. | 405/302 |
| 3,309,880 | 3/1967 | Potts et al. | 405/302 |
| 3,530,490 | 9/1970 | Ward et al. | 405/302 X |
| 3,541,926 | 11/1970 | Grebe | 405/302 X |
| 3,821,880 | 7/1974 | Weirich et al. | 405/302 |
| 3,967,539 | 7/1976 | Williamson | 91/404 |
| 4,151,978 | 5/1979 | Frei | 91/404 X |

*Primary Examiner*—Dennis L. Taylor

*Attorney, Agent, or Firm*—Sughrue, Rothwell, Mion, Zinn and Macpeak

[57] ABSTRACT

A hydraulic control system is provided for a roof support unit of an underground mining installation. The roof support unit is provided with a roof cap supported by hydraulic props. The control system comprises a valve for controlling the supply of pressurized hydraulic fluid to the props, and an actuator for closing the valve when the props have been retracted by a predetermined amount.

19 Claims, 1 Drawing Figure

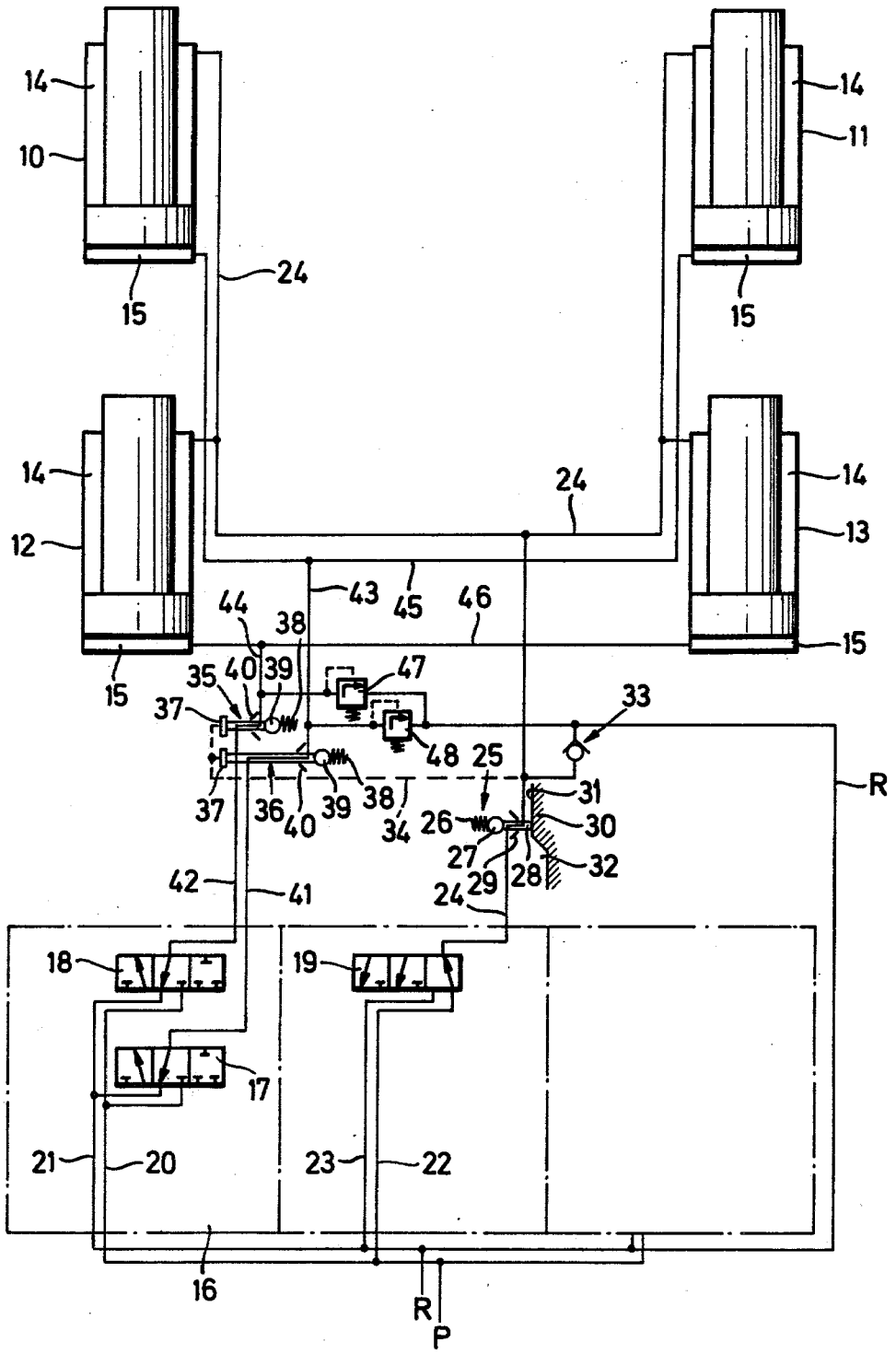
14
10
15
24
14
11
15
14
12
15
24
14
13
15
43
45
46
44
38
35
40
39
47
37
48
33
25
37
36
40
39
38
34
26
31
30
27
29
28
32
R
42
41
24
18
19
17
21
20
23
22
16
R
P

HYDRAULIC ROOF SUPPORT CONTROL SYSTEM

BACKGROUND TO THE INVENTION

This invention relates to a hydraulic control system for a roof support assembly of an underground mining installation.

A known type of roof support assembly is constituted by a plurality of identical roof support units positioned side-by-side along, for example, a longwall face. Each unit is provided with hydraulic advance ram means so that the units can be advanced individually, or in groups, to follow the advance of the mineral face being won. Such an assembly is known as a walking frame roof support assembly. Each roof support unit is typically constituted by a floor sill, a roof cap and a goaf shield, the roof cap being supported by hydraulic props which rest on the floor sill. Such a roof support assembly is provided with a hydraulic control system which is used to control the various operations of each of the units of the assembly, such as the retraction of the props prior to the advance of a unit, advance of that unit, and extension of the rams after the advance. The control system may be operated manually by either proximity or remote control, and the units may be controlled either individually or in groups.

Although the known hydraulic roof support control systems have proved quite reliable in practice, they do suffer from a number of disadvantages. In particular, when the props of a given roof support unit are retracted, the extent of this retraction depends entirely upon the degree of control exercised by the operating personnel. Consequently, there is a danger that, as the roof support units are advanced, the props are forcibly retracted to too great an extent. This is particularly dangerous when mining seams of small thickness. In the extreme case, the roof cap of a unit may be lowered to such an extent that, if sufficient attention is not paid, the face workers might suffer serious, or even fatal injuries by being crushed between the downward moving roof support parts and the floor of the working.

However, even where seams of large thickness are being mined, the roof caps of the roof support units may be lowered to an unnecessary extent during the advance operation. For example, if the roof caps of adjacent units bear against one another for guide purposes, their supporting and guiding functions may cease if the roof caps are lowered too far, so that considerable working difficulties can arise.

The aim of the invention is to provide a control system for a hydraulic roof support assembly which does not suffer from the disadvantages outlined above.

SUMMARY OF THE INVENTION

According to one aspect of the present invention, there is provided a hydraulic control system for a roof support unit of an underground mining installation, the roof support unit being provided with a roof cap supported by a hydraulic prop means, the control system comprising a valve for controlling the supply of pressurised hydraulic fluid to the prop means, and an actuator for closing the valve when the prop means has been retracted by a predetermined amount.

According to another aspect of the present invention, there is provided a control system for an underground mining installation, the control system comprising hydraulic roof-supporting prop means, a valve for controlling the supply of pressurized hydraulic fluid to the prop means, and an actuator for closing the valve when the prop means has been retracted by a predetermined amount.

Advantageously, the prop means is constituted by a plurality of hydraulic props each of which has a first working chamber, pressurisation of which causes retraction of that prop, and a second working chamber, pressurisation of which causes extension of that prop, said valve controlling, in use, the supply of pressurised hydraulic fluid to the first working chambers of the props. Preferably, the prop means is constituted by four props.

Said valve may be provided in a first supply line which leads to the first working chambers of the props, the first supply line being optionally connectible to a pressure line or a return line by actuation of a first control valve.

The provision of this valve ensures that the forcible retraction of the props is limited in a positive manner, and is not dependent upon correct action from operating personnel. Thus, retraction of the props to too great an extent is effectively prevented.

Preferably, said valve is a spring-loaded slide valve which is opened, against the force of its spring, by cooperation of the actuator and the slide.

The actuator may be constituted by a mechanical switching element such as a cam. Advantageously, the cam is fixed to a part movable, in use, with the retracting prop means, said valve being fixed to a stationary part of the installation in the path of the cam. Preferably, the cam is adjustably fixed to the roof cap of the roof support unit.

Advantageously, supply line means leads to the second working chambers of the props, the supply line means being optionally connectible to the pressure line or the return line by control valve means. The supply line means may be provided with servo-valve means for controlling the flow of pressurised hydraulic fluid to the second working chambers of the props. Preferably, the servo-valve means is spring biassed towards its closed position, and is openable, against this biassing force, by pressurizing its servo-piston means.

The servo-piston means may be pressurised via a control line leading from the first supply line on the outlet side of said valve. The servo-valve means may be openable, against the biassing force, by the pressure of hydraulic fluid in the supply line means when the supply line means is connected to the pressure line by the control valve means.

In a preferred embodiment, a pair of parallel supply lines constitute the supply line means, a respective servo-valve being provided in each of said parallel supply lines, the two servo-valve constituting the servo-valve means. In this case, the control valve means is constituted by second and third control valves, the second control valve being provided in one of the parallel supply lines and the third control valve being provided in the other parallel supply line. A first of the servo-valves may control the flow of pressurised fluid to the second working chamber(s) of at least one, but not all the props, and the second servo-valve controls the flow of pressurised fluid to the second working chamber of the or each of the remainder of the props. Where there are four props, each servo-valve controls the flow of pressurised fluid to the second working chamber of two of the props.

Advantageously, each of the parallel supply lines constituting the supply line means is provided with a respective branch line leading from the outlet side of the corresponding servo-valve and terminating in the return line, each branch line being provided with a respective pressure-relief valve.

Preferably, the control system further comprises overload protection means for providing pressurised hydraulic fluid to the prop means after said valve has closed and in the event of an overload acting on the prop means. Thus, even after said valve has limited the retraction of the prop means, further retraction of the prop means is possible in the event of an overload acting say on the roof cap. Since, in the event of such an overload, the roof support is pushed down very slowly, this does not constitute a serious danger to face workers.

Advantageously, the control line is connected to the outlet of the non-return valve.

BRIEF DESCRIPTION OF THE DRAWING

A control system for a hydraulic roof support assembly and constructed in accordance with the invention will now be described by way of example, with reference to the accompanying drawing, the single FIGURE of which is a circuit diagram of that part of the control system associated with one roof support unit of the assembly.

DESCRIPTION OF PREFERRED EMBODIMENT

Referring to the drawing, the roof support unit has four hydraulic props 10, 11, 12 and 13, each of which has an annular working chamber 14 which can be pressurised for the purpose of retracting the props. Each prop 10, 11, 12 and 13 also has a cylindrical working chamber 15 whch can be pressurised for the purpose of extending the props.

The control system includes a manually actuable control valve device 18 which is used to control the various operations of the roof support unit, namely the retraction and extension of the props 10, 11, 12 and 13, and the advance of the unit. The device 16 is constituted by three control valves 17, 18 and 19 each of which is a slide valve. These three valves 17, 18 and 19 can be combined to form a single composite slide valve, or they can be formed in a common control block. The input of each control valve 17 and 18 is connected to a hydraulic pressure line P by way a line 20 and to a hydraulic return line R by way of a line 21. Similarly, the input of the control valve 19 is connected to the pressure line P and the return line R by means of respective lines 22 and 23. The pressure and return lines P and R run along the entire face and supply pressurized hydraulic fluid to each of the roof support units.

The output side of the control valve 19 is connected, by way of a line 24, to the annular working chambers 14 of the four hydraulic props 10, 11, 12 and 13. A spring-loaded slide valve 25 is provided in the line 24. This valve 25 has a valve closure member 27 biassed towards its closed position by means of a spring 26, the closure member being liftable from its valve seat 29 by means of a slide 28. The valve 25 is actuated by means of a cam 30 which is fitted onto part of the roof support unit (for example the roof cap) that is lowered as the props 10, 11, 12 and 13 are retracted. The cam 30 has a raised portion 31 and a recessed portion 32 joined by an inclined portion **32*a*. The raised portion 31 contacts the slide 28 over the major part of the retraction stroke of the props 10, 11, 12 and 13 so that the closure member 27 is lifted from its valve seat 29 against the force of the spring 26, thus establishing a path for pressurising the working chambers 14 of the props. However, as soon as the slide 28 contacts the recessed portion 32 of the cam 30, the valve 25 closes under the action of the spring 26, thus cutting off the line 24 from further pressurisation from the pressure line P via the control valve 19**.

Although the cam 30 is used to actuate the valve 25, any other suitable form of mechanical switching means could be utilised for this purpose. Moreover, instead of positioning the cam 30 on a movable part of the roof support unit and having the valve 25 stationary, the arrangement could be reversed by positioning the valve 25 on the movable part of the unit and having the cam 30 fixed.

At the output side of the valve 25, the line 24 is connected to the return line R via a branch line provided with a non-return valve 33. A control line 34 also leads from the line 24 at the output side of the valve 25, this control line 34 being connected to two servo-valves 35 and 36 which are arranged in parallel. Each of the servo-valves 35 and 36 has a control piston 37, a closure member 39, a valve seat 40 and a spring 38 which biasses the closure member towards the valve seat. As long as the pistons 37 are not pressurised via the control line 34, the valves 35 and 36 are closed owing to the biassing force of their springs 38.

The output side of the control valves 17 and 18, which are arranged in parallel, are connected to the input sides of the servo-valves 36 and 35 by respective lines 41 and 42. The output side of the servo-valve 36 is connected to the working chambers 15 of the props 10 and 11 by way of lines 43 and 45; and the output side of the servo-valve 35 is connected to the working chambers 15 of the props 12 and 13 by way of lines 44 and 46. The output sides of the servo-valves 35 and 36 are each connected to the return line R by way of branch lines incorporating respective pressure-relief valves 47 and 48.

The control system described above operates in the following manner. Assuming the various valves are in the positions illustrated (that is to say the control system is in the prop-retraction position), the pressure line P is connected to the working chambers 14 of the four props 10, 11, 12 and 13 via the line 22, the control valve 19, the line 24 and the valve 25, the valve 25 being open owing to the abutment of its slide 28 with the raised portion 31 of the cam 30. Thus, the props 10, 11, 12 and 13 are forcibly retracted, during which process pressurised hydraulic fluid flows from the working chambers 15 of the props 10 and 11 to the return line R via the lines 45 and 43, the servo-valve 36, the line 41 and the control valve 17. At the same time, pressurised hydraulic fluid flows from the working chambers 15 of the props 12 and 13 to the return line R via the lines 46 and 44, the servo-valve 35, the line 42 and the control valve 18. The servo-valves 35 and 36 are open at this stage, since, when the valve 25 is open, pressurised hydraulic fluid acts on their control pistons 37 via the control line 34.

When the props 10, 11, 12 and 13 have been retracted by the desired amount, the slide 28 of the valve 25 moves off the raised portion 31 of the cam 30, along the inclined portion **32*a* and into engagement with the recessed portion 32. At this point, the valve 25 closes under the action of the spring 26 so that the flow of pressurised hydraulic fluid to the working chambers 14 of the props 10, 11, 12 and 13 is cut off. At the same time, the control line 34 is depressurised so that the control pistons 37 of the servo-valves 35 and 36 are relieved of pressure and the servo-valves are closed under the action of their springs 38. The retraction of the props 10, 11, 12 and 13 is, therefore, terminated in a positive manner, the position at which this occurs being easily predetermined by suitable positioning of the valve 25 and the cam 30**.

After the valve 25 has been closed, the props 10, 11, 12 and 13 can be retracted further, in the event of an overload, since their working chambers 15 are connected to the return line R via the pressure-relief valves 47 and 48. This prevents an overload on the roof cap causing damage to the roof support unit. Moreover, there is little danger to personnel since, in the event of such an overload, the props 10, 11, 12 and 13 are retracted very slowly.

In order to extend the props 10, 11, 12 and 13, after advance of the roof support unit, the control valves 17, 18 and 19 are manually actuated so that the lines 41 and 42 are connected to the pressure line P, and the line 24 is connected to the return line R. Pressurised hydraulic fluid acting on the closure members 39 of the servo-valves 35 and 36, via the lines 41 and 42, opens these valves so that the working chambers 15 of the props 10, 11, 12 and 13 are pressurised. As the props 10, 11, 12 and 13 are extended, hydraulic fluid flows from their working chambers 14 to the return line R via the line 24 and the open valves 25 and 19, the valve 25 being opened at the start of the prop extension process by the co-operation of its slide 28 with the raised portion 31 of the cam 30.

The particular function of the non-return valve 33 is to enable the props 10, 11, 12 and 13 to be retracted beyond the predetermined limit set by the valve 25, in the event of an overload. Thus, when the pressure-relief valves 47 and 48 open, fluid can flow back into the working chambers 14 of the props 10, 11, 12 and 13 via the line 24 and the non-return valve 33.

We claim:

1. In a hydraulic control system for a roof support unit of an underground mining installation, the roof support unit including a roof cap supported by hydraulic prop means capable of controlled movement over a fixed range between extended and retracted positions, and the control system including a valve for controlling the supply of pressurised hydraulic fluid from a source to the prop means, the improvement comprising: an actuator for closing said valve to terminate the supply of pressurised hydraulic fluid to the prop means as soon as the prop means has been retracted by a predetermined amount less than said fixed range.

2. A control system according to claim 1, wherein the prop means is constituted by a plurality of hydraulic props each of which has a first working chamber, pressurisation of which causes retraction of that prop, and a second working chamber, pressurisation of which causes extension of that prop, said valve controlling the supply of pressurised hydraulic fluid to the first working chambers of the props.

3. A control system according to claim 2, wherein the prop means is constituted by four props.

4. A control system according to claim 2, wherein said valve is provided in a first supply line which leads to the first working chambers of the props, the first supply line being optionally connectible to a pressure line or a return line by actuation of a first control valve.

5. A control system according to claim 2, wherein said valve is a spring-loaded slide valve which is opened, against the force of its spring, by co-operation of the actuator and the slide.

6. A control system according to claim 5, wherein the actuator is constituted by a mechanical switching element.

7. A control system according to claim 6, wherein a cam constitutes the mechanical switching element.

8. A control system according to claim 4, wherein supply line means leads to the second working chambers of the props, the supply line means being optionally connectible to the pressure line or the return line by control valve means.

9. A control system according to claim 8, wherein the supply line means is provided with servo-valve means for controlling the flow of pressurised hydraulic fluid to the second working chambers of the props.

10. A control system according to claim 9, wherein the servo-valve means is spring biassed towards its closed position, and is openable, against this biassing force, by pressurising pistons of the servo-valve means.

11. A control system according to claim 10, wherein said pistons are pressurised via a control line leading from the first supply line on the outlet side of said valve.

12. A control system according to claim 11, wherein the servo-valve means is also openable, against the biassing force, by the pressure of hydraulic fluid in the supply line means when the supply line means is connected to the pressure line by the control valve means.

13. A control system according to claim 12, wherein a pair of parallel supply lines constitute the supply line means, a respective servo-valve being provided in each of said parallel supply lines, the two servo-valves constituting the servo-valve means.

14. A control system according to claim 13, wherein the control valve means is constituted by second and third control valves, the second control valve being provided in one of the parallel supply lines and the third control valve being provided in the other parallel supply line.

15. A control system according to claim 13, wherein a first of the servo-valves control the flow of pressurised fluid to the second working chamber(s) of at least one of the props, and the second servo-valve controls the flow of pressurised fluid to the second working chamber of at least one other of the props.

16. A control system according to claim 13, wherein each of the parallel supply lines constituting the supply line means is provided with a respective branch line leading from the outlet side of the corresponding servo-valve and terminating in the return line, each branch line being provided with a respective pressure-relief valve.

17. A control system according to claims 1, 4 or 14, further comprising overload protection means for providing pressurised hydraulic fluid to the prop means after said valve has closed and in the event of an overload acting on the prop means.

18. A control system according to claim 17, wherein the overload protection means is constituted by a non-return valve provided in a line connecting the outlet of said valve and the return line.

19. A control system according to claim 18, wherein the control line is connected to the outlet of the non-return valve.

* * * * *